US011035348B2

(12) United States Patent
Marica

(10) Patent No.: US 11,035,348 B2
(45) Date of Patent: Jun. 15, 2021

(54) RECIPROCATING PUMPS HAVING A PIVOTING ARM

(71) Applicant: National Oilwell Varco, L.P., Houston, TX (US)

(72) Inventor: Adrian Marica, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 180 days.

(21) Appl. No.: 16/133,147

(22) Filed: Sep. 17, 2018

(65) Prior Publication Data

US 2020/0072201 A1 Mar. 5, 2020

Related U.S. Application Data

(60) Provisional application No. 62/723,885, filed on Aug. 28, 2018.

(51) Int. Cl.
*F04B 9/02* (2006.01)
*F04B 1/143* (2020.01)
(Continued)

(52) U.S. Cl.
CPC ..... *F04B 9/02* (2013.01); *F04B 1/128* (2013.01); *F04B 1/143* (2013.01); *F04B 9/04* (2013.01);
(Continued)

(58) Field of Classification Search
CPC ..... F04B 1/143; F04B 53/109; F04B 1/0439; F04B 1/128; F04B 9/047; F04B 19/04
See application file for complete search history.

(56) References Cited

U.S. PATENT DOCUMENTS 1,489,636 A * 4/1924 Gilson ..... F04B 49/20 74/60
1,687,029 A * 10/1928 Mcclatchie ..... F04B 1/00 417/568
(Continued)

FOREIGN PATENT DOCUMENTS

DE 721098 C 6/1942
DE 3727174 A1 2/1989
(Continued)

OTHER PUBLICATIONS

International Patent Application No. PCT/US2019/048246 International Search Report and Written Opinion dated Nov. 14, 2019 (14 pages).

*Primary Examiner* — Bryan M Lettman
*Assistant Examiner* — Timothy P Solak
(74) *Attorney, Agent, or Firm* — Conley Rose, P.C.

(57) ABSTRACT

A pump assembly including a power end including an output shaft having an output shaft axis. In addition, the pump assembly includes a fluid end including a piston configured to reciprocate to pressurize the working fluid. Further, the pump assembly includes a transmission coupled to each of the power end and the fluid end. The transmission includes a carriage coupled to the piston and a pivoting arm pivotably coupled to the carriage at a first connection about a first pivot axis. The first pivot axis extends in a perpendicular direction to a direction of the output shaft axis, and rotation of the output shaft about the output shaft axis is configured to cause the pivoting arm to pivot about the first pivot axis at the first connection and to cause the carriage to reciprocate.

20 Claims, 7 Drawing Sheets

(51) Int. Cl.

| | |
|---|---|
| ***F04B 19/22*** | (2006.01) |
| ***F04B 23/06*** | (2006.01) |
| ***F04B 1/128*** | (2020.01) |
| ***F04B 9/04*** | (2006.01) |
| *F04B 53/10* | (2006.01) |
| *F04B 17/03* | (2006.01) |

(52) U.S. Cl.
CPC ..... *F04B 19/22* (2013.01); *F04B 23/06* (2013.01); *F04B 17/03* (2013.01); *F04B 53/109* (2013.01)

(56) References Cited

U.S. PATENT DOCUMENTS

| | | | | |
|---|---|---|---|---|
| 3,871,268 | A * | 3/1975 | Misima | F04B 9/045 92/13.3 |
| 4,360,324 | A * | 11/1982 | Ohara | A61M 1/106 417/388 |
| 5,330,331 | A * | 7/1994 | Doede | F04B 7/0011 417/519 |
| 5,492,457 | A | 2/1996 | Lee | |
| 5,846,056 | A | 12/1998 | Dhindsa et al. | |
| 6,510,366 | B1 * | 1/2003 | Murray | A45D 44/00 700/233 |
| 8,220,496 | B2 * | 7/2012 | Marica | F04D 29/466 138/37 |
| 8,714,193 | B2 * | 5/2014 | Marica | F04B 53/129 137/533.21 |
| 2012/0152360 | A1 | 6/2012 | Marica | |
| 2012/0255734 | A1 | 10/2012 | Coli et al. | |
| 2014/0348677 | A1 | 11/2014 | Moeller et al. | |
| 2015/0354329 | A1 | 12/2015 | Perry et al. | |

FOREIGN PATENT DOCUMENTS

| | | | |
|---|---|---|---|
| DE | 19726702 | A1 | 1/1999 |
| DE | 102014212021 | A1 | 12/2015 |
| EP | 0220527 | A1 | 5/1987 |
| FR | 911137 | A | 6/1946 |
| FR | 2262753 | A1 | 9/1975 |
| WO | 2011/050585 | A1 | 5/2011 |
| WO | 2014/071130 | A1 | 5/2014 |
| WO | 2017/123656 | A2 | 7/2017 |

* cited by examiner

RECIPROCATING PUMPS HAVING A PIVOTING ARM

CROSS-REFERENCE TO RELATED APPLICATIONS

This application claims benefit of U.S. Provisional Patent Application No. 62/723,885 filed Aug. 28, 2018, and entitled "Pump Assemblies and Pumping Systems Incorporating Pump Assemblies," which is hereby incorporated herein by reference in its entirety for all purposes.

STATEMENT REGARDING FEDERALLY SPONSORED RESEARCH OR DEVELOPMENT

Not applicable.

BACKGROUND

This disclosure relates generally to systems for pressurizing a working fluid. More particularly, some embodiments of this disclosure relate to pumping systems that include one or more direct drive pump assemblies for pressurizing a working fluid for subsequent injection into a subterranean wellbore.

To form an oil or gas well, a bottom hole assembly (BHA), including a drill bit, is coupled to a length of drill pipe to form a drill string. The drill string is then inserted downhole, where drilling commences. During drilling, fluid (or "drilling mud") is circulated down through the drill string to lubricate and cool the drill bit as well as to provide a vehicle for removal of drill cuttings from the borehole. After exiting the bit, the drilling fluid returns to the surface through an annulus formed between the drill string and the surrounding borehole wall (or a casing pipe lining the borehole wall). Mud pumps are commonly used to deliver drilling fluid to the drill string during drilling operations. Many conventional mud pumps are of a triplex configuration, having three piston-cylinder assemblies driven out of phase by a common crankshaft and hydraulically coupled between a suction manifold and a discharge manifold. During operation of the mud pump, each piston reciprocates within its associated cylinder. As the piston moves to expand the volume within the cylinder, drilling fluid is drawn from the suction manifold into the cylinder. After the piston reverses direction, the volume within the cylinder decreases and the pressure of drilling fluid contained with the cylinder increases. When the piston reaches the end of its stroke, pressurized drilling fluid is exhausted from the cylinder into the discharge manifold. While the mud pump is operational, this cycle repeats, often at a high cyclic rate, and pressurized drilling fluid is continuously fed to the drill string at a substantially constant rate.

BRIEF SUMMARY

Some embodiments disclosed herein are directed to a pump assembly for pressurizing a working fluid. In an embodiment, the pump assembly includes a base, and a power end mounted to the base, the power end comprising an output shaft having an output shaft axis. In addition, the pump assembly includes a fluid end mounted to the base, the fluid end comprising a piston configured to reciprocate within the fluid end to pressurize the working fluid. Further, the pump assembly includes a transmission coupled to each of the power end and the fluid end. The transmission includes a carriage coupled to the piston and reciprocally coupled to the base. In addition, the transmission includes a pivoting arm pivotably coupled to the carriage at a first connection about a first pivot axis. The first pivot axis extends in a direction that is perpendicular to a direction of the output shaft axis. Wherein rotation of the output shaft about the output shaft axis is configured to cause the pivoting arm to pivot about the first pivot axis at the first connection and to cause the carriage to reciprocate relative to the base.

Other embodiments disclosed herein are directed to a pumping system. In an embodiment, the pumping system includes a suction manifold, a discharge manifold, and a plurality of pump assemblies configured to draw a working fluid from the suction manifold, pressurize the working fluid, and deliver the pressurized working fluid to the discharge manifold. Each of the plurality of pump assemblies includes a base, a power end mounted to the base, the power end comprising an output shaft having an output shaft axis. In addition, each of the pump assemblies includes a fluid end mounted to the base, the fluid end comprising a piston configured to reciprocate within the fluid end to pressurize the working fluid. Further, each of the pump assemblies includes a transmission coupled to each of the power end and the fluid end. The transmission includes a carriage coupled to the piston and reciprocally coupled to the base, and a pivoting arm pivotably coupled to the carriage at a first connection about a first pivot axis. The first pivot axis extends in a direction that is perpendicular to a direction of the output shaft axis. Wherein rotation of the output shaft about the output shaft axis is configured to cause the pivoting arm to pivot about the first pivot axis at the first connection and to cause the carriage to reciprocate relative to the base.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
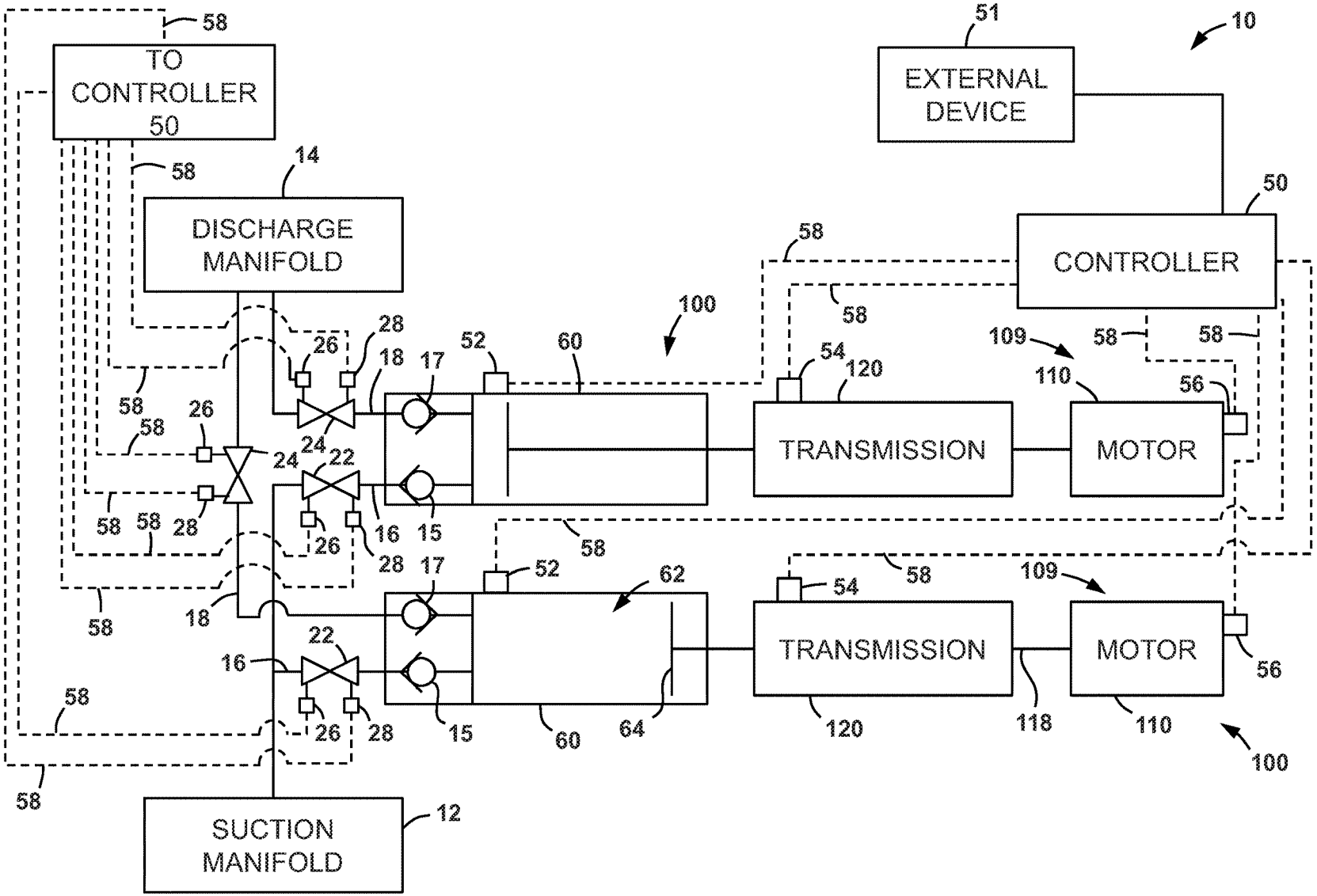
FIG. 1 is a schematic view of an embodiment of a pumping system according to at least some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the terms "gimbal," "gimbal member," and the like, refers to a pivoted support that allows the rotation of an object about an axis.

As previously described above, mud pumps, including multiple piston-cylinder assemblies driven out of phase by a common crankshaft, are typically used to deliver drilling fluid to a drill string during drilling operations. These pumps have a set footprint and configuration. Thus, if it is desired to increase the flow rate of drilling fluid above what the piston-cylinder assemblies can deliver, an additional mud pump must be installed, or another mud pump must be designed and fabricated that includes the appropriate number of piston-cylinder assemblies to provide the desired flow rate of drilling fluid. As a result, these conventional mud pumps are not easily adaptable to the changing specifications and needs of many drilling applications. In addition, adequate space must be provided at the drill site to accommodate not only the size of these mud pumps but also the set footprint thereof.

Accordingly, embodiments disclosed herein include pumping systems for pressurizing a working fluid (e.g., drilling fluid injected into a subterranean wellbore), that include a plurality of modular pump assemblies. As a result, the number and specific arrangement of the modular pump assemblies may be altered as desired to accommodate a specific flow rate, pressure, and spacing requirements of the drilling operation.

Referring now to FIG. 1, a pumping system 10 for pressurizing a working fluid (e.g., drilling mud) is shown. Pumping system 10 generally includes a suction manifold 12, a discharge manifold 14, and a plurality of pumping assemblies 100. Suction manifold 12 is in fluid communication with a working fluid source (e.g., a mud pit), and discharge manifold 14 is in fluid communication with a fluid delivery point (e.g., a central throughbore of a drill string). Each pump assembly 100 is coupled to suction manifold 12 with a corresponding suction line 16, and is coupled to discharge manifold 14 with a corresponding discharge line 18, such that each pump assembly 100 is configured to receive fluids from suction manifold 12 via the corresponding suction line 16, and emit pressurized fluid to one of the discharge manifolds 14 via the corresponding discharge line 18.

Each pump assembly 100 includes a power end 109, a transmission 120, and a fluid end 60. In this embodiment, power end 109 comprises a motor 110 including an output shaft 112. Motor 110 may be any suitable motor or driver that is configured to actuate (e.g., rotate) an output shaft 118, such as, for example, an electric motor, hydraulic motor, internal combustion engine, turbine, etc. In this embodiment, motor 110 comprises an electric motor 110.

Transmission 120 comprises any suitable mechanism that is configured to translate the output from motor 110 into an input drive for fluid end 60. For example, in this embodiment, motor 110 drives the rotation of output shaft 118, and transmission 120 is configured to convert the rotational motion of output shaft 118 into a reciprocal motion for driving a piston 64 within fluid end 60 (note: in some embodiments, pistons 64 may be replaced with a plunger or other reciprocating member, thus, the term "piston" is used herein to include various designs of pistons, plungers, bladders, and other suitable reciprocating members for use within fluid end 60). While some specific embodiments of transmission 120 are discussed below, it should be appreciated that transmission 120 may comprise any suitable arrangement of gears, cams, sliders, carriages, or other components to affect the desired motion conversion between motor 110 and fluid end 60.

Fluid end 60 defines a chamber 62 that receives piston 64 therein. Piston 64 is coupled to transmission 120 and is configured to reciprocate within chamber 62 and sealingly engage with the inner walls of chamber 62 to facilitate the pressurization and flow of a working fluid (e.g., drill mud) therein. Fluid end 60 includes a suction valve 15 and a discharge valve 17. Suction valve 15 is configured to allow fluid flow into chamber 62 via suction line 16 when piston 64 withdrawn from chamber 62 (e.g., toward transmission 120) and the pressure within chamber 62 falls below a first predetermined level, but to prevent fluid from flowing out of chamber 62 into line 16. Discharge valve 17 is configured to allow fluid to flow out of chamber 62 into discharge line 18 when piston 64 is advanced into chamber 62 (e.g., away from transmission 120) and the pressure within chamber 62 rises above a second predetermined level, but to prevent fluid from flowing into chamber 62 from discharge line 18. While valves 15, 17 are merely shown schematically in FIG. 1, it should be appreciated that valves 15, 17 may be the same or similar to those disclosed in U.S. Pat. Nos. 8,220,496 and/or 8,714,193, the entire contents of each being incorporated herein by reference for all purposes.

Referring still to FIG. 1, pumping system 10 includes a plurality of suction valves 22 and discharge valves 24. Each of the suction valves 22 is disposed along one of the suction lines 16 and each of the discharge valves 24 is disposed along one of the discharge lines 18. Each of the valves 22, 24 is coupled to a central controller 50 through a corresponding connection 58, which may be any suitable wired or wireless connection for communicating signals, such as, for example a cable, wire, fiber optic line, radio frequency (RF) connection, a WIFI connection, BLUETOOTH® connection, short wave communication signal, acoustic connection, etc. Controller 50 may include a processor and a memory, wherein each of the processor and memory may comprise one or more electrical circuits. The memory includes computer readable instructions for execution by the processor to provide all of the functionality of controller 50 disclosed herein. Each of the valves 22, 24 also includes a pair of sensors 26, 28 that are configured to sense whether the corresponding valve (e.g., valve 22, 24) is opened or closed (i.e., whether the valves 22, 24 are in an open position or a closed position, respectively). Specifically, one sensor 26 is configured to sense when the corresponding valve is in the open position (to thereby allow fluid to flow freely along the corresponding line 16, 18), and the other sensor 28 is configured to sense when the corresponding valve is in the closed position (to thereby prevent or restrict fluid flow along the corresponding line 16, 18). The sensors 26, 28 are each configured to communicate with controller 50 via connections 58 so that controller 50 may know whether each valve 16, 18 is in the open or closed position. In this embodiment, controller 50 is coupled to an external device 51, which may comprise, for example, a display (e.g., a computer monitor) that is further configured to display information (e.g., a graphic) that shows which of the valves 22, 24 is in the open position and which of the valves 22, 24 is in the closed position. In addition, in some embodiments, controller 50 may be configured to actuate each of the valves 22, 24 between the open and closed positions.

Each pump assembly 100 includes a plurality of sensors that communicate with controller 50 to facilitate and optimize the control thereof during operations. For example, in this embodiment, each pump assembly 100 includes a rotary sensor 56 coupled to motor 110 and configured to measure or determine the rotational speed and/or direction of the output shaft 118. In addition, each pump assembly 100 includes a linear displacement or position sensor 54 coupled to transmission 120 or fluid end 60 (in this embodiment, sensor 54 is coupled to transmission 120) and configured to measure or determine the position or displacement of piston 64 relative to some fixed point. Further, each pump assembly 100 includes a pressure sensor 52 coupled to fluid end 60 and configured to measure a pressure of the chamber 62 during operations. Each of the sensors 52, 54, 56 are coupled to controller 50 through a corresponding connection 58, where connections 58 between sensors 52, 54, 56 and controller 50 are configured the same as the connections 58 between sensors 26, 28 and controller 50.

In some embodiments, controller 50 drives motors 110 so that the pistons 64 of pump assemblies 100 operate in phase with one another but with a continuously variable angle or timing between them (e.g., via controller 50) to produce a relatively constant flow of pressurized working fluid to discharge manifold. Specifically, in this embodiment, because pumping system 10 includes two pump assemblies, the pistons 64 are operated approximately 180° out of phase with one another (i.e., so that as each piston 64 reaches its maximum extension during a discharge stroke, the other piston reaches its minimum extension during a suction stroke). However, it should be appreciated that the phase difference between pistons 64 of pump assemblies 100 will change as the number of pump assemblies 100 is increased or deceased (e.g., if three pump assemblies 100 are used, each piston 64 is operated approximately 120° out of phase with the other pistons 64). In some embodiments, controller 110 verifies and/or maintains the proper timing of the strokes of pistons 64 (e.g., to maintain the desired phase separation of pistons 64) by sensing the motor rotational speed and direction via rotary sensors 56 and correlating the measured rotational speed to the position of piston 64 via linear displacement or position sensors 54.

For each pump assembly 100, as motor 110 drives rotation of output shaft 118, transmission 120 converts this rotational motion into a reciprocating motion so that piston 64 is repetitively driven between a suction stroke and a discharge stroke within chamber 62. During a suction stroke of piston 64, piston 64 is withdrawn toward transmission 120 such that the pressure within chamber 62 is reduced to draw in working fluid from line 16 via suction valve 15. In addition, during a suction stroke, working fluid is prevented from flowing into chamber 62 by discharge valve 17. Conversely, during a discharge stroke, piston 64 is driven or extended away from transmission 120, such that the pressure within chamber 62 is increased to force fluid out of chamber 62 into discharge line 18 via discharge valve 17. In addition, during a discharge stroke, working fluid is prevented from flowing out of chamber 62 into suction line 16 by suction valve 15.

Specific embodiments of pump assemblies 100 will now be described in more detail. It should be appreciated that any one or more of these embodiments discussed below may be incorporated into pumping system 10 of FIG. 1.

Figure 2:
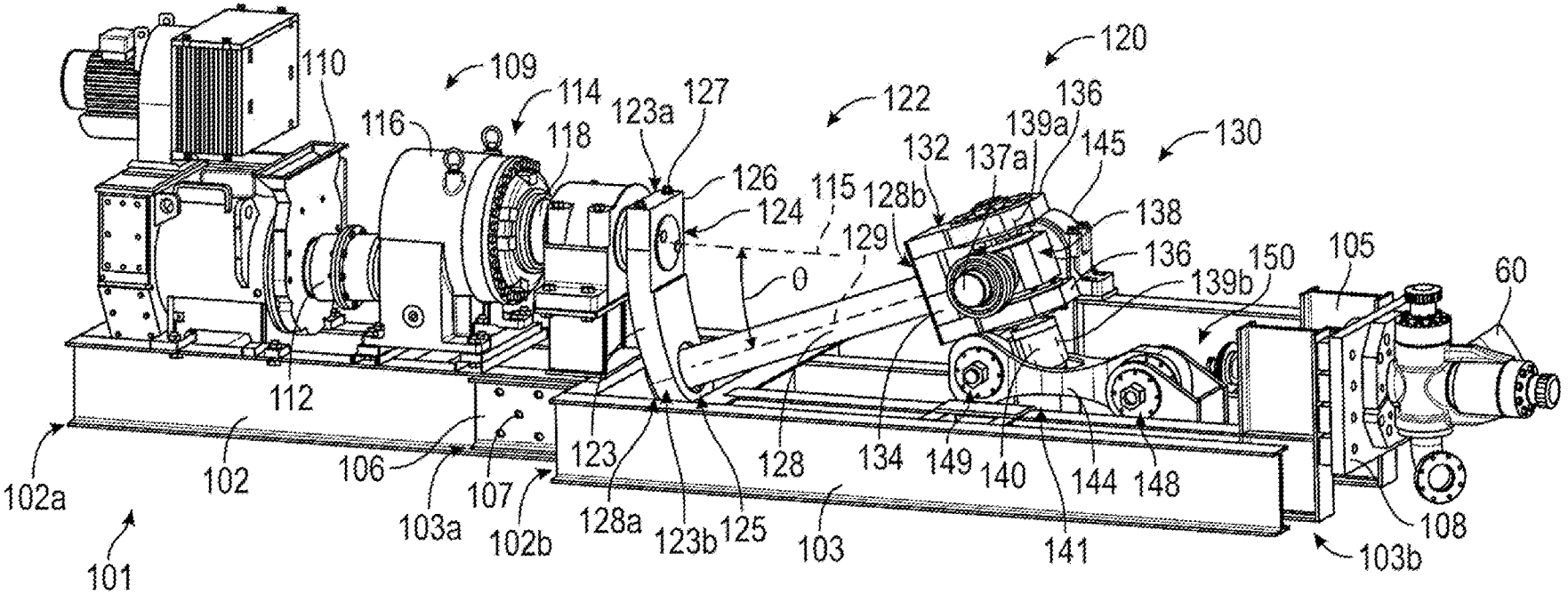
FIG. 2 is a schematic view of an embodiment of a pump assembly for use within the pumping system of FIG. 1 according to at least some embodiments.

Referring now to FIG. 2, embodiment of pump assembly 100 is shown. As previously described, pump assembly 100 includes power end 109, transmission 120, and fluid end 60. In some embodiments, fluid end 60 may be the same as the fluid end embodiments disclosed in WO2017/123656. Pump assembly 100 may be referred to as a modular unit in that the components of pump assembly 100 may be easily disassembled, assembled, and/or interchanged with other similar components. This may facilitate transportation, design, maintenance, and replacement of pump assembly 100 and the components thereof during operations.

In the embodiment of FIG. 2, power end 109 includes both motor 110 and a reducer 114. The reducer 114 is coupled between a shaft 112 of motor 110 and transmission 120. In particular, reducer 114 includes a reducer gear assembly 116 that is coupled to shaft 112 and an output shaft 118 that engages with transmission 120. Thus, in this embodiment output shaft 118 may be referred to as an "output shaft" of power end 109. In this embodiment, reducer gear assembly 116 is configured to rotate output shaft 118 a fraction of the number of times that shaft 112 rotates. Specifically, in this embodiment, reducer gear assembly 116 is configured to rotate output shaft 118 one time for every sixteen rotations of shaft 112 of motor 110. Thus, reducer gear assembly 116 works to reduce the rotational rate (e.g., in rotations per minute (rpm)) of shaft 112 of motor 110 and to increase the torque supplied to transmission 120 from that generated by motor 110 alone. It should be appreciated, that in some embodiments, no reducer 114 is included and shaft 112 of motor 110 couples directly to transmission 120 (such that shaft 112 may be referred to as an "output shaft" of power end 109 in these embodiments). In other embodiments, reducer gear assembly 116 is incorporated into motor 110 itself such that reducer gear assembly 116 would be disposed within an outer housing of motor 110 and output shaft 118 of reducer 114 would effectively be the output shaft of motor 110 itself.

Referring still to FIG. 2, pump assembly 100 also includes a base or frame 101 to support power end 109, transmission 120, and fluid end 60. In this embodiment, base 101 includes a first or motor base 102, and a second or transmission base 103 coupled to motor base 102. Motor base 102 supports power end 109 including motor 112 and reducer 114, while transmission base 103 supports transmission 120 and fluid end 60.

Motor base 102 comprises a first end 102*a*, and a second end 102*b* that is opposite first end 102*a*. Similarly, transmission base 103 includes a first end 103*a*, and a second end 103*a* that is opposite first end 103*a*. Motor base 102 is coupled to the first end 103*a* of transmission base 103 at second end 102*b* via one or more mounting plates 106 that are disposed on first end 103*a* of transmission base 103. Mounting plates 106 each include a plurality of holes or apertures 107 for receiving bolts or other connection members (e.g., screws, pins, rivets, etc.) therethrough. In addition, transmission base 103 includes a pair of vertically oriented support extensions 105 at second end 103*b* that form a frame for supporting fluid end 60 on base 103. In this embodiment, a mounting plate 108 is coupled to extensions 105 and fluid end 60 is mounted to plate 107. However, in other embodiments, fluid end 60 may be secured to extensions 105 without a mounting plate 108 (e.g., fluid end 60 may be secured to extensions 105 via separate bracket or other support member or may be directly mounted to extensions 105 without utilizing a separate support or mounting member).

Power end 109 may be decoupled from transmission 120 and bases 102, 103 may also be decoupled at mounting plates 106 so that power end 109 may be transported or maneuvered separately from transmission 120 and fluid end 60 on base 103. In addition, fluid end 60 may be decoupled from base 103 and moved, repaired, replaced via the connection at plate 108 and beams 105. Therefore, bases 102, 103 help to facilitate the modularity of pump assembly 100 by providing relatively simple attachment points between the components (e.g., specifically between motor 110 and reducer 114 and transmission 120, and between transmission 120 and fluid end 60).

Figure 3:
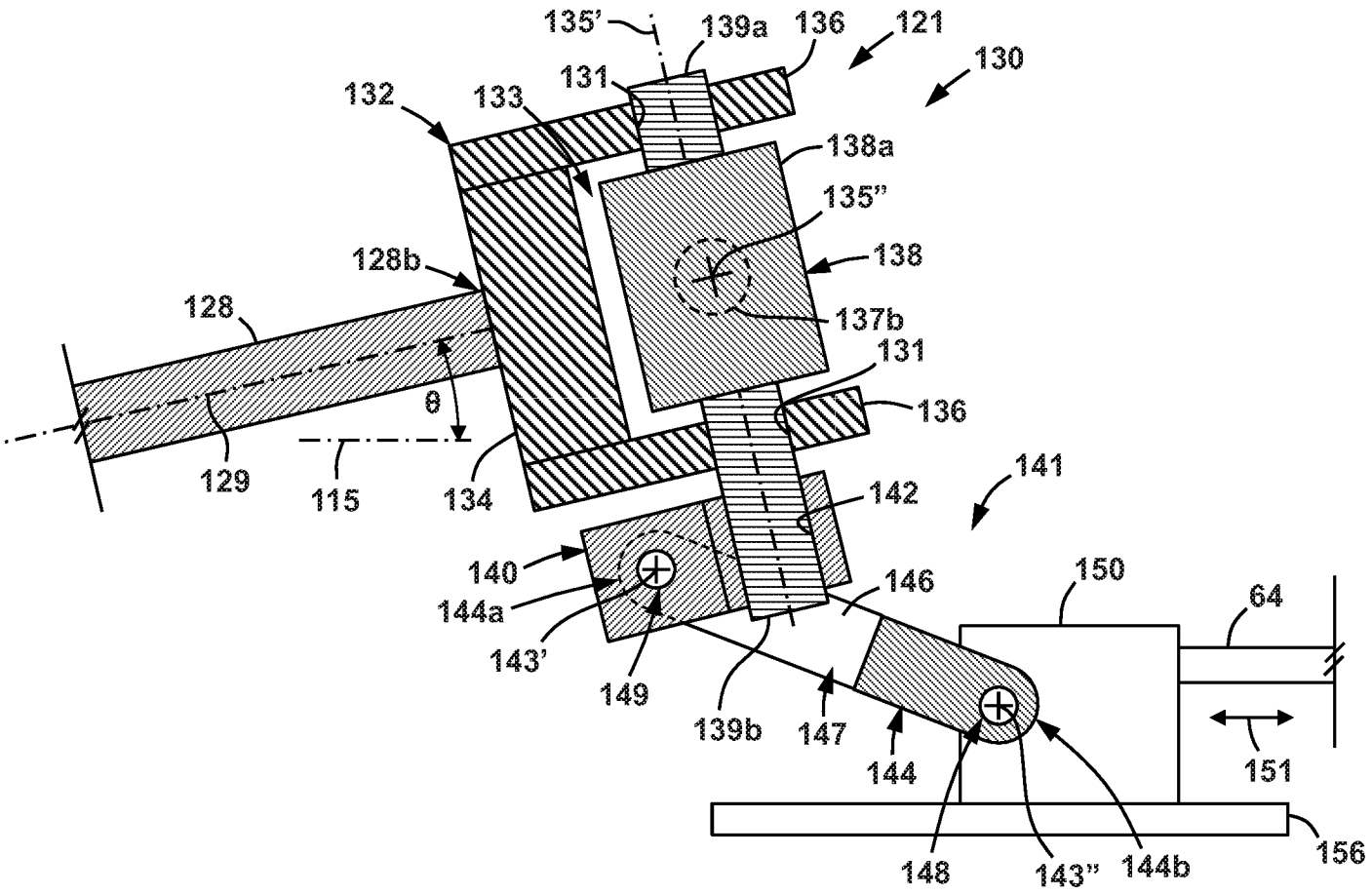
FIG. 3 is a schematic, partial, side cross-sectional view of the transmission of the pump assembly of FIG. 2.
Figure 4:
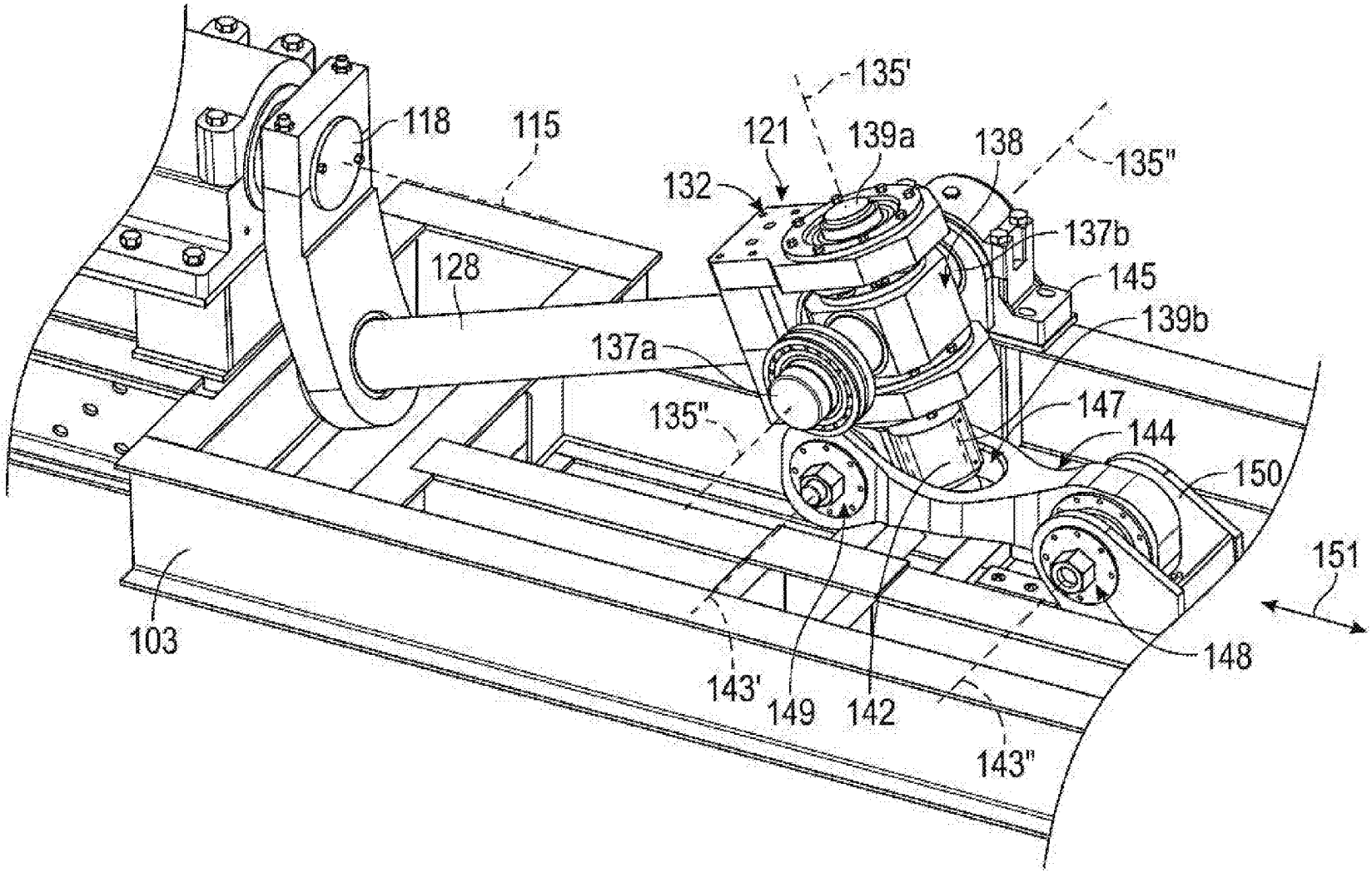
FIGS. 4 and 5 are partial perspective views of the transmission of the pump assembly of FIG. 2.
Figure 5:
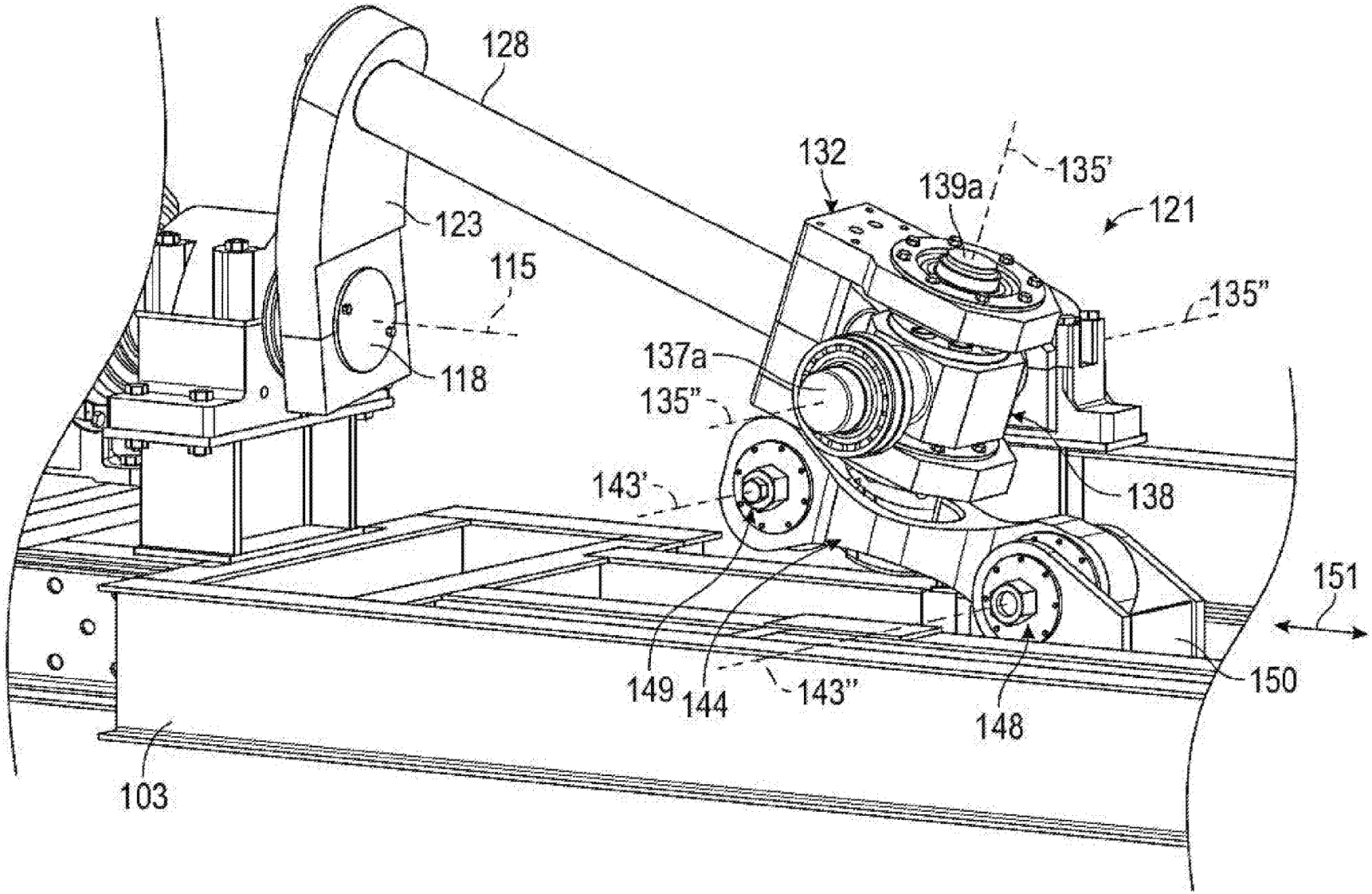

Referring now to FIGS. 2 and 3, transmission 120 provides a linkage between power end 109 and the fluid end 60 to drive reciprocation of piston 64 within fluid end 60 (e.g., see also FIG. 1) to pressurize a working fluid as previously described above. Specifically, transmission 120 converts the rotational motion of output shaft 118 of reducer 114 (or output shaft of motor 112) into a reciprocal motion of the piston 64 within fluid end 60. In this embodiment, transmission 120 includes an offset shaft assembly 122 coupled to output shaft 118, a carriage 150 coupled to the piston 64, a pivoting arm assembly 141 coupled to the carriage 150, and a linking assembly 130 coupled between the offset shaft assembly 122 and pivoting arm assembly 141.

Carriage 150 is coupled to piston 64 that is reciprocally disposed within fluid end 60 as previously described (see also FIG. 1). During operations, carriage 150 is driven to reciprocate relative to transmission frame 103 by power end 109 via offset shaft assembly 122, linking assembly 130, and pivoting arm assembly 141. As a result, the reciprocation of carriage 150 drives reciprocation of the piston 64. As shown in FIG. 3, the reciprocation of carriage 150 may be facilitated and supported by one or more tracks 156 that are mounted to frame 103 (note: frame 103 is not shown in FIG. 3 so as not to unduly complicate the figure). In some embodiments, carriage 150 may be similar to the carriages (or carriage assemblies) described in WO2017/123656.

Referring again to FIG. 2, offset shaft assembly 122 includes an offset collar member 123 and a shaft 128. Offset collar member 123 is an elongate member having a first end 123*a*, a second end 123*b* opposite the first end 123*a*, a first throughbore 124, and a second throughbore 125. As shown in FIG. 2, first throughbore 124 is disposed more proximate to first end 123*a* than second end 123*b*, and second throughbore 125 is disposed more proximate to second end 123*b* than first end 123*a*.

Second throughbore 125 receives a first end 128*a* of shaft 128, and first throughbore 124 receives an end of output shaft 118 of reducer 114. In this embodiment output shaft 118 is mounted within throughbore 124 such that no relative rotation between shaft 118 and throughbore 124 is allowed (i.e., such that offset collar member 123 rotates with output shaft 118 during operation). In some embodiments, shaft 118 and throughbore 124 may include a corresponding keyed or splined connection. In other embodiments, output shaft 118 may include one or more facets or planar surfaces that interact with corresponding planar surfaces within throughbore 124 (e.g., output shaft 118 and throughbore 124 may include polygonal cross-sections).

In addition, in the embodiment of FIG. 2, offset collar member 123 includes a connector 126 at first end 123*a* that forms a portion (e.g., half) of first throughbore 124. Connector 126 may be secured to the rest of offset collar member 123 about shaft 118 via a plurality of bolts 127 (or other suitable connection members (e.g., screws, pins, rivets, etc.).

Shaft 128 is an elongate member that includes first end 128*a* and a second end 128*b* opposite first end 128*a*. First end 128*a* of shaft 128 is received within second throughbore 125 of offset collar member 123, as previously described, such that shaft 128 may rotate freely relative to offset collar member 123 during operations. For example, one or more bearings (e.g., radial or spherical bearings—not shown) may be disposed within throughbore 125 to facilitate the relative rotation between shaft 128 and collar member 123.

Referring again to FIGS. 2 and 3, in this embodiment, offset collar member 123 (or at least a portion thereof) extends outward from a central axis 115 of output shaft 118 at an angle (not specifically marked in FIG. 2) that is between 0° and 90° (i.e., offset collar member 123 extends at an acute angle to axis 115 of output shaft 118). Thus, when first end 128*a* of shaft 128 is received through second throughbore 125, shaft 128 extends along an axis 129 that is disposed at an angle θ to axis 115 of output shaft 118. Axis 115 may be referred to herein as the output shaft axis 115, and the axis 129 may be referred to herein as the offset shaft axis 129. The angle θ may range between 0° and 90°. In some embodiments, the angle θ may range from 10° to 50°, or from 15° to 23°. In other embodiments, offset collar member 123 may extend radially outward (e.g., at 90°) from axis 115 of shaft 118.

During operations, as output shaft 118 is rotated about axis 115, offset collar 123 is also caused to rotate about axis 115 at throughbore 124 (e.g., due to the connection between shaft 118 and throughbore 124 as previously described above). As a result, second throughbore 125 and first end 128*a* of shaft 128 are also caused rotate about axis 115 such that axis 129 of shaft 128 traces a cone (not shown) that has sides extending at the angle θ relative to axis 115.

Referring still to FIGS. 2 and 3, as previously described linking assembly 130 is coupled between each of the offset shaft assembly 122 and carriage 150. In this embodiment, linking assembly 130 comprises a universal joint (U-joint) assembly 121 (or more simply "U-joint 121"), that is mounted to second end 128*b* of offset shaft 128 and is pivotably coupled to carriage 150 via a pivoting arm assembly 141.

U-joint 121 includes a first gimbal member 132 and a second gimbal member 138 pivotably coupled to one another. First gimbal member 132 includes a base 134 and a pair of parallel extensions 136 extending from base 134 that define a recess 133 therebetween. Second end 128*b* of shaft 128 is engaged with base 134 such that first gimbal member 132 may not rotate relative to shaft 128. Any suitable connection may be used between first gimbal member 132 and shaft 128, such as, for example, threads, a flanged coupling, welding, clamps, etc. Each of the extensions 136 includes a throughbore 131 extending therethrough that are aligned with one another along a pivot axis 135' extending across recess 133.

Second gimbal member 138 includes a central body 138*a*, a first pair of shafts 137*a*, 137*b*, and a second pair of shafts 139*a*, 139*b*. Each of the shafts 137*a*, 137*b* extend from a first pair of opposing sides of body 138*a* and each of the shafts 139*a*, 139*b* extend from a second pair of opposing sides of body 138*a*. Central body 138*a* is received within recess 133 and the second pair of shafts 139*a*, 139*b* are pivotably inserted through throughbores 131 of projections 136, such that shafts 139*a*, 139*b* are aligned along pivot axis 135'. Thus, body 138*a* of second gimbal member 138 may freely pivot about pivot axis 135' relative to first gimbal member 132 due to the coupling between throughbores 131 and shafts 139*a*, 139*b*. Any suitable bearing or similar coupling may be used between throughbores 131 and shafts 139*a*, 139*b* (e.g., radial and/or spherical bearings) to support the relative rotation therebetween. However, shafts 139*a*, 139*b* may be secured within throughbores 131, such that axial movement of second gimbal member 138 relative to first gimbal member 132 along pivot axis 135' is prevented (or at least restricted).

As best shown in FIG. 2, the first pair of shafts 137*a*, 137*b* of second gimbal member 138 are pivotably received within a pair of shaft mounts 145 mounted to transmission base 103 such that shafts 137*a*, 137*b* are disposed along a pivot axis 135" that is orthogonal to pivot axis 135'. Only one shaft mount 145 is shown in FIG. 2 (i.e., the other shaft mount 145 and the associated portion of base 103 for supporting the shaft mount 145 is hidden in FIG. 2 so as to more clearly show the components of linking assembly 130). However, it should be appreciated that the un-depicted shaft mount 145 (and the portion of base 103 supporting shaft mount 145) would be the same as the depicted shaft mount 145 (and base support) in FIG. 2, and would be disposed on the opposing side of the linking assembly 130 from the depicted shaft mount (and base support). Body 138*a* of second gimbal member 138 may freely pivot relative to mounts 145 about pivot axis 135". In addition, due to the connection between shafts 139*a*, 139*b* and throughbores 131 in projections 136, first gimbal member 132 and second gimbal member 138 may both pivot together about pivot axis 135" during operations.

Referring still to FIGS. 2 and 3, pivoting arm assembly 141 includes a sleeve member 140 and a pivoting arm 144. Sleeve member 140 includes a sleeve 142 that receives shaft 139*b* extending from body 138*a*. Pivoting arm 144 includes a first end 144*a*, a second end 144*b* opposite first end 144*a*, and a pair of connecting arms 146 extending from first end 144*a* that form a recess 147 extending therebetween. First end 144*a* of pivoting arm 144 is pivotably coupled sleeve member 140, while second end 144*b* of pivoting arm 144 is pivotably coupled to carriage 150. In particular, a first connection (e.g., a pinned coupling) 148 extends through each of the pivoting arm 144 and carriage assembly 152 proximate second end 144*b*. In addition, sleeve member 140 is received within recess 147 between arms 146 and a second connection (e.g., a pinned connection) 149 extends between arms 146 and sleeve member 140. Thus, pivoting arm 144 may pivot relative to carriage 150 about a pivot axis 143" at first connection 148, and pivoting arm 144 and sleeve member 140 may pivot relative to one another about a pivot axis 143' at second connection 149. In addition, as pivoting arm 144 and sleeve member 140 pivot relative to one another about axis 143' about second connection 149, sleeve 142 (and shaft 139*b* disposed therein) may be received within recess 147. Pivot axes 143', 143" are parallel and radially offset from one another. In addition, each of the pivot axes 143', 143" are parallel to and radially offset from pivot axis 135", and each of the pivot axes 143', 143" extending in directions that are perpendicular to the direction of axis 135' and the direction of output shaft axis 115. Moreover, each of the axes 143', 143", 135" lie within vertically oriented planes that extend perpendicularly to a vertically oriented plane containing the output shaft axis 115 (assuming that base 101 is level on a support surface).

Referring now to FIGS. 2-5, during operations, output shaft 118 of reducer 116 is rotated about axis 115 by motor 110 as previously described, which further causes offset collar member 123 to rotate about axis 115. The rotation of collar member 123 about axis 115 further causes shaft 128 to orbit about axis 115 and thereby trace a cone as previously described. The orbit of shaft 128 about axis 115 causes first gimbal member 132 to reciprocally pivot relative to second gimbal member 138 about pivot axis 135' (via the relative pivoting between shafts 139*a*, 139*b* and throughbores 131 in extensions 136 as previously described above). Simultaneously, the orbit of shaft 128 causes first and second gimbal members 132, 138 to reciprocally pivot together about pivot axis 135".

As gimbal members 132, 138 pivot about axis 135", sleeve member 140 is driven to reciprocally pivot about axis 143' relative to pivoting arm 144 due to the engagement between sleeve 142 and shaft 139*b*, at second connection 149. In addition, the pivoting of gimbal member 132, 138 about pivot axis 135" also causes pivoting arm 144 to pivot relative to carriage 150 about pivot axis 143", at first connection 148. As best shown in the sequence between FIGS. 4 and 5, the reciprocal pivoting of gimbal members 132, 138 about axis 135" and the simultaneous reciprocal pivoting of sleeve member 140 and pivoting arm 144 about connections 149, 148 ultimately causes a reciprocal translation of second end 144*b* of pivoting arm 144 along a direction 151 that is parallel to and radially offset from axis 115. This axial translation of second end 144*b* of pivoting arm 144 along direction 151 also causes or drives reciprocation of carriage 150 along track 156 mounted to base 103 in the direction 151. Because carriage 150 is coupled to the piston 64 (which is disposed within fluid end 60—see FIG. 1), the reciprocation of carriage 150 along direction 151 drives the reciprocation of piston 64 within the fluid end 60 to provide a flow of pressurized working fluid from pump assembly 100 as previously described above.

Figure 6:
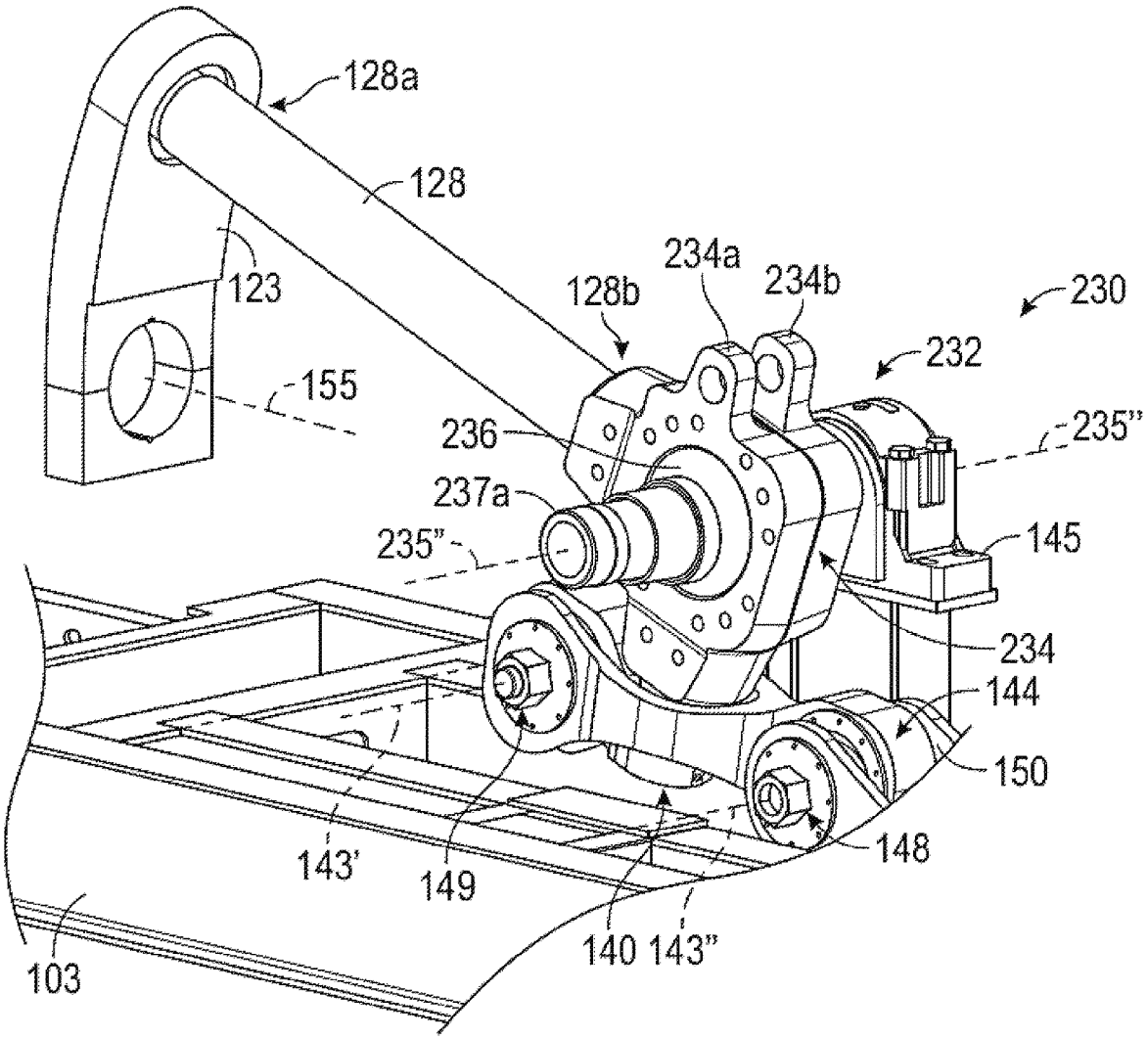
FIG. 6 is a partial perspective view of the transmission of another pump assembly for use within the pumping system of FIG. 1 according to at least some embodiments.
Figure 7:
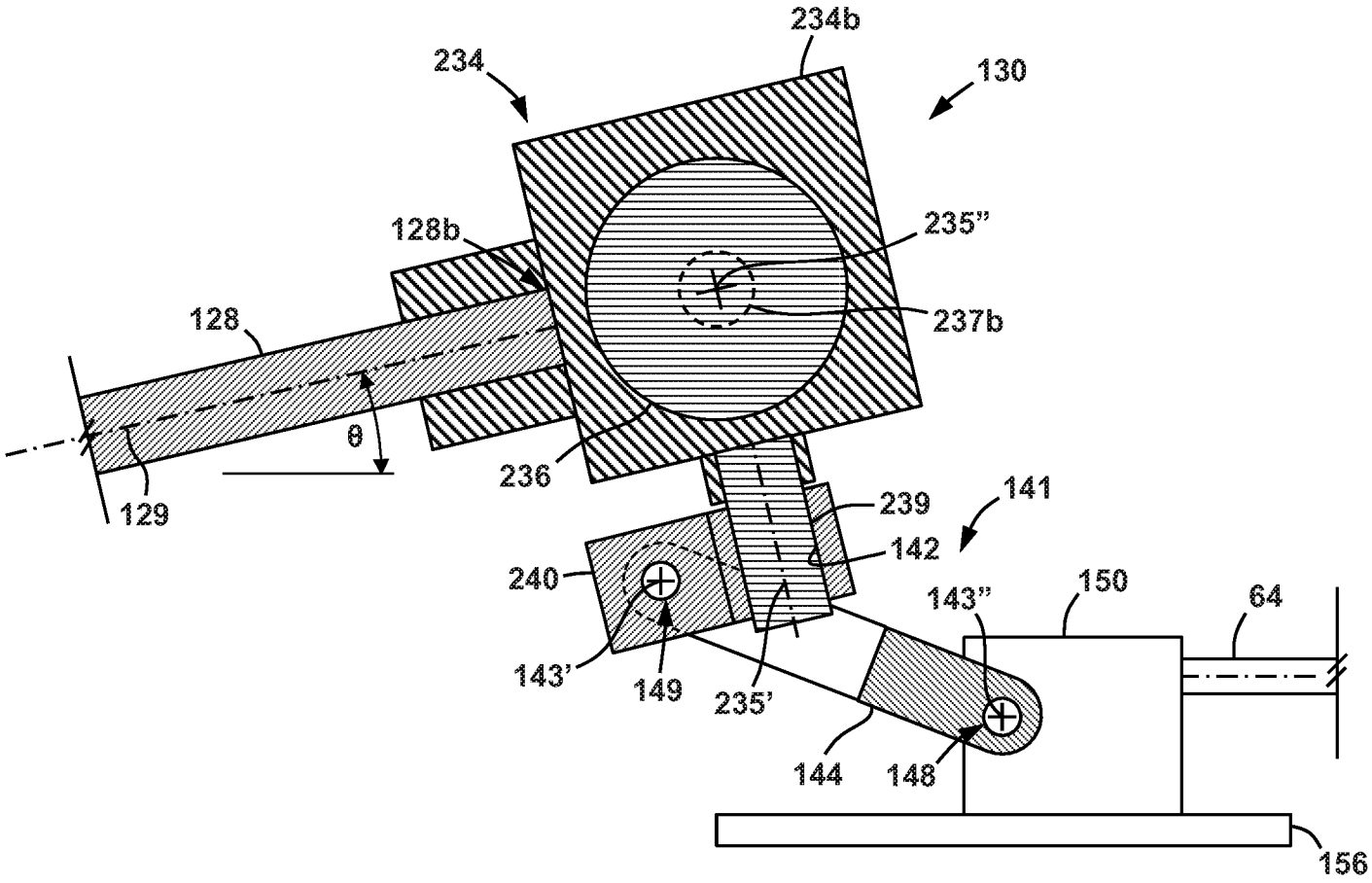
FIG. 7 is a schematic, partial cross-sectional view of the transmission of FIG. 6.

Referring now to FIGS. 6 and 7, another embodiment of linking assembly (which is identified as linking assembly 230 herein) is shown for use within pump assembly 100 in place of linking assembly 130. Many components of linking assembly 230 are the same as those found in linking assembly 130, and thus, like components are identified with like reference numerals and the description below will focus on the components of linking assembly 230 that are different from linking assembly 130 (see FIG. 3).

In particular, linking assembly 230 includes a spherical connection assembly 232 in place of U-Joint 121. Spherical connection assembly 232 is mounted to second end 128*b* of offset shaft 128 and is pivotably coupled to carriage 150 via the pivoting arm assembly 141 in substantially the same manner as linking assembly 130. Spherical connection 232 includes a clamp assembly 234 and a spherical member or ball 236. Ball 236 includes a pair of shafts 237*a*, 237*b* that extend out of opposing sides of ball 236 along an axis 235".

Clamp assembly 234 includes a pair of clamp members 234*a*, 234*b* that are secured to one another about ball 236 via plurality of bolts (not shown) extending through aligned apertures 237 in clamp members 234*a*, 234*b*. In addition, second end 128*b* of shaft 128 is engaged with or coupled to clamp members 234*a*, 234*b* such that a projection of axis 129 is orthogonal to axis 235". Further, a shaft 239 is mounted to clamp members 234*a*, 234*b* and extends along a pivot axis 235'. A projection of pivot axis 235' is orthogonal to axis 235" and is orthogonal to a projection of axis 129 of shaft 128. Accordingly, axis 235" and a projection of each of the axes 235' and 129 extend through the center of ball 236. During operations, the clamp members 234*a*, 234*b* may slidingly engage with outer surface of ball 236 such that clamp members 234*a*, 234*b* may pivot omni-directionally about ball 236 (specifically the center of ball 236).

Referring still to FIGS. 6 and 7, shaft 239 is received with sleeve 142 of sleeve member 140 in the same manner that shaft 139*b* is received within sleeve 142 of linking assembly 130. In addition, shafts 237*a*, 237*b* are received within shaft mounts 145 supported on base 101 such that ball 236 is fixed relative to base 103. Specifically, ball 236 is not configured to rotate relative to base 101 about shafts 237*a*, 237*b*. As with linking assembly 130, in FIG. 6 only one of the shaft mounts 145 (and the associated support on base 103) is shown so as to better show the details of linking assembly 230. In other examples, ball 236 may pivot relative to base 101 about shafts 237*a*, 237*b*. Without being limited to this or any other theory, the rotation of ball 236 about shafts 237*a*, 237*b* may reduce some of the relative movement between ball 236 and clamp members 234*a*, 234*b* and thereby reduce wear, over time, to ball 236.

Further, the same relationships exist between axes 143', 143" and axis 115 as described above in the embodiment of FIGS. 2-6. In this embodiment, axes 143', 143" are parallel to and radially offset from axis 235", and axes 235", 143', 143" each lie within vertically oriented planes that extend perpendicularly to a vertically oriented plane containing axis 115 of output shaft 118. Thus, axes 235", 143', 143" each extend in directions that are perpendicular to the direction of axis 115.

During operations, as shaft 128 is orbited about axis 115 in the manner described above, clamp assembly 234 (including clamp members 234*a*, 234*b*) pivots about ball 236. Simultaneously, shaft 239 is driven to rotate along with sleeve member 140 about axis 143' relative to pivoting arm 144, and pivoting arm 144 is pivoted about each of the axes 143', 143" relative to sleeve member 140 and carriage 150 in the same manner as previously described above for linking assembly 130. As a result, carriage 150 and piston 64 are driven to reciprocate in direction 151 (e.g., along track 156) as previously described.

During the operational life of a pump assembly 100 (see FIG. 2) utilizing linking assembly 230, the sliding engagement between ball 236 and clamp members 234*a*, 234*b* may cause gradual wear of ball 236. Due to the omni-directional movement of clamp members 234*a*, 234*b* about ball 236, the wear may be relatively uniform so that the diameter of ball 236 will gradually decrease. In order to maintain appropriate and desired engagement between ball 236 and clamp members 234*a*, 234*b*, the bolts extending through the aligned apertures 237 on clamp members 234*a*, 234*b* may be engaged or adjusted as a part of the regular maintenance of pump assembly 100 (see FIG. 2). In addition, in some embodiments, one or more spacers or shims may be disposed between clamp members 234*a*, 234*b*, and as ball 236 wears (and therefore shrinks) as previously described, the shims may be replaced and/or removed to provide an appropriate spacing and engagement between the clamp members 234*a*, 234*b*. As a result, through use of the linking assembly 230 (which includes spherical connection assembly 232), the operational life of the original parts making up the linking assembly 230 may be increased (e.g., particularly ball 236), which thereby reduces the overall lifetime operational costs for pump assembly 100.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A pump assembly for pressurizing a working fluid, the pump assembly comprising:

a base;

a power end mounted to the base, the power end comprising an output shaft having an output shaft axis;

a fluid end mounted to the base, the fluid end comprising a piston configured to reciprocate within the fluid end to pressurize the working fluid; and a transmission coupled to each of the power end and the fluid end wherein the transmission comprises:

an offset shaft coupled to the output shaft, wherein the offset shaft comprises an offset axis that is disposed at a non-zero angle θ relative to the output shaft axis;

a linking assembly coupled to the offset shaft;

a carriage coupled to the piston and reciprocally coupled to the base; and a pivoting arm pivotably coupled to the carriage at a first connection about a first pivot axis, wherein the first pivot axis extends in a direction that is perpendicular to a direction of the output shaft axis; and a sleeve member pivotably coupled to the pivoting arm at a second connection about a second pivot axis and coupled to the linking assembly at a third connection;

wherein rotation of the output shaft about the output shaft axis is configured to cause the offset shaft to orbit about the output shaft axis, and to cause the pivoting arm to pivot about the first pivot axis at the first connection and to pivot about the second pivot axis at the second connection, and to cause the carriage to reciprocate relative to the base.

2. The pump assembly of claim 1, wherein the second connection is spaced from the first connection along the pivoting arm and the second pivot axis is parallel to and radially offset from the first pivot axis.

3. The pump assembly of claim 2, wherein the angle θ is between 0 and 90°.

4. The pump assembly of claim 3, wherein the transmission further comprises an offset collar member having a first through bore and a second throughbore spaced from the first throughbore, wherein the output shaft is received within the first throughbore;

wherein a first end of the offset shaft is received within the second throughbore; and wherein rotation of the output shaft about the output shaft axis is configured to cause the offset collar member to rotate about the output shaft axis and to cause the offset shaft to rotate within the second throughbore of the offset collar member.

5. The pump assembly claim 2, wherein the linking assembly comprises a universal joint assembly, the universal joint assembly comprising:

a first gimbal member coupled to the offset shaft; and a second gimbal member pivotably coupled to the first gimbal member and pivotably coupled to the pivoting arm at the second connection.

6. The pump assembly of claim 5, wherein the first gimbal member comprises a first body and a pair of parallel projections extending from the first body;

wherein second gimbal member comprises second body, a first pair of shafts, and a second pair of shafts, wherein the first pair of shafts and the second pair of shafts extend outward from the second body;

wherein the first pair of shafts are pivotably coupled to the base; and wherein the second pair of shafts are pivotably coupled to the projections of the first gimbal member.

7. The pump assembly of claim 6, wherein the first pair of shafts is aligned along a third pivot axis, wherein the second pair of shafts is aligned along a fourth pivot axis, and wherein the third axis is orthogonal to the fourth axis.

8. The pump assembly of claim 7, wherein the fourth pivot axis extends in a direction that is perpendicular to the direction of the offset shaft axis.

9. The pump assembly of claim 2, wherein the linking assembly comprises:

a ball coupled to the base; and a clamp assembly disposed about the ball, wherein the clamp assembly is configured to pivot omni-directionally about the ball.

10. The pump assembly of claim 9, wherein the clamp assembly is mounted to the offset shaft and pivotably coupled to the pivoting arm at the second connection.

11. A pumping system, comprising:

a suction manifold;

a discharge manifold; and a plurality of pump assemblies configured to draw a working fluid from the suction manifold, pressurize the working fluid, and deliver the pressurized working fluid to the discharge manifold;

wherein each of the plurality of pump assemblies comprises:

a base;

a power end mounted to the base, the power end comprising an output shaft having an output shaft axis;

a fluid end mounted to the base, the fluid end comprising a piston configured to reciprocate within the fluid end to pressurize the working fluid; and a transmission coupled to each of the power end and the fluid end wherein the transmission comprises:

an offset coupled to the output shaft, wherein the offset shaft comprises and offset shaft axis that is disposed at a non-zero angle θ relative to the output shaft axis;

a linking assembly coupled to the offset shaft;

a carriage coupled to the piston and reciprocally coupled to the base;

a pivoting arm pivotably coupled to the carriage at a first connection about a first pivot axis, wherein the first pivot axis extends in a direction that is perpendicular to a direction of the output shaft axis; and a sleeve member pivotably coupled to the pivoting arm at a second connection about a second pivot axis and coupled to the linking assembly at a third connection;

wherein rotation of the output shaft about the output shaft axis is configured to cause the offset shaft to orbit about the output shaft axis, and to cause the pivoting arm to pivot about the first pivot axis at the first connection and to pivot about the second pivot axis at the second connection, and to cause the carriage to reciprocate relative to the base.

12. The pumping system of claim 11, wherein the second connection is spaced from the first connection along the pivoting arm and the second pivot axis is parallel to and radially offset from the first pivot axis.

13. The pumping system of claim 12, wherein the angle θ is between 0 and 90°.

14. The pumping system of claim 13, wherein the transmission of each pump assembly further comprises an offset collar member having a first through bore and a second throughbore spaced from the first throughbore, wherein the output shaft is received within the first throughbore;

wherein a first end of the offset shaft is received within the second throughbore; and wherein rotation of the output shaft about the output shaft axis is configured to cause the offset collar member to rotate about the output shaft axis and to cause the offset shaft to rotate within the second throughbore of the offset collar member.

15. The pumping system of claim 12, wherein for each pump assembly, the linking assembly comprises a universal joint assembly, the universal joint assembly comprising:

a first gimbal member coupled to the offset shaft; and a second gimbal member pivotably coupled to the first gimbal member and pivotably coupled to the pivoting arm at the second connection.

16. The pumping system of claim 15, wherein for each pump assembly, the first gimbal member comprises a first body and a pair of parallel projections extending from the first body;

wherein second gimbal member comprises second body, a first pair of shafts, and a second pair of shafts, wherein the first pair of shafts and the second pair of shafts extend outward from the second body;

wherein the first pair of shafts are pivotably coupled to the base; and wherein the second pair of shafts are pivotably coupled to the projections of the first gimbal member.

17. The pumping system of claim 16, wherein for each pump assembly, the first pair of shafts is aligned along a third pivot axis, wherein the second pair of shafts is aligned along a fourth pivot axis, and wherein the third axis is orthogonal to the fourth axis.

18. The pumping system of claim 17, wherein for each pump assembly, the fourth pivot axis extends in a direction that is perpendicular to the direction of the offset shaft axis.

19. The pumping system of claim 12, wherein for each pump assembly, the linking assembly comprises:

a ball coupled to the base; and a clamp assembly disposed about the ball, wherein the clamp assembly is configured to pivot omni-directionally about the ball.

20. The pumping system of claim 19, wherein for each pump assembly, the clamp assembly is mounted to the offset shaft and pivotably coupled to the pivoting arm at the second connection.

* * * * *